US005148871A

United States Patent [19]

Gullion

[11] Patent Number: 5,148,871

[45] Date of Patent: Sep. 22, 1992

[54] TENSION ADAPTER ASSEMBLY FOR COMPLETION RISER

[75] Inventor: Steven D. Gullion, Knaresborough, England

[73] Assignee: Cooper Industries, Inc., Houston, Tex.

[21] Appl. No.: 697,717

[22] Filed: May 9, 1991

[51] Int. Cl.[5] ..... E21B 7/128

[52] U.S. Cl. ..... 166/345; 166/355; 166/359

[58] Field of Search ..... 166/335, 345, 355, 217, 166/237, 358, 359

[56] References Cited

U.S. PATENT DOCUMENTS 3,791,442 2/1974 Watkins ..... 166/355
4,403,658 9/1983 Watkins ..... 166/355
4,428,433 1/1984 Watkins ..... 166/355
4,557,332 12/1985 Denison et al. ..... 166/345
4,616,707 10/1986 Langner ..... 166/345
4,616,708 10/1986 da Mota ..... 166/355
4,646,841 3/1987 Schawann et al. ..... 166/355

*Primary Examiner*—Ramon S. Britts
*Assistant Examiner*—Frank S. Tsay

[57] ABSTRACT

The improved structure of the present invention is provided to utilize the drilling riser tension ring and rig tensioning to tension a completion riser. A tension sleeve is provide which is secured to the upper end of the completion riser and is designed to have a diameter sufficiently small to allow it to pass through the spider in the rotary table. An adapter tension ring is also provided which is secured to the drilling riser tension ring and has a design allowing the tension sleeve to pass therethrough and be secured therein so that raising the sleeve may raise the adapter tension ring and tension exerted on the drilling riser tension ring or the adapter tension ring may be utilized in tensioning the completion riser.

3 Claims, 7 Drawing Sheets

45°
30°
10
12
14
18
20
22
24
26
28
30
32
34
38
40
2
4

TENSION ADAPTER ASSEMBLY FOR COMPLETION RISER

BACKGROUND

The present invention relates to an improved apparatus which provides a connection between a completion riser and a drilling riser tension ring.

Risers, both drilling and completion risers, used on subsea wells normally do not have the strength to prevent buckling and normally such risers are maintained in tension which is supplied by the tension lines from the drilling rig or platform. Attaching the rig tension lines can be a laborious task for the rig hands who are suspended by air tugger lines underneath the rotary table. The rig hand must pull the drooping tension cables to the riser tension joint and shackle the cable ends to pad eyes on the joint. Because of the cable size and numbers (sometimes up to ten) connecting the tension lines to the riser tension joint can take a significant amount of rig time to perform.

Advancements have been made in connecting tension lines to drilling riser systems. A tension ring assembly with tension lines already connected is stored underneath the rotary table. Drilling riser joints are run through the tension ring in the conventional manner. The tension joint in the system is equipped with a large shoulder that mates with the tension ring. When this tension joint is lowered through the rotary, the tension ring is remotely locked onto the tension joint's shoulder and released from the rotary table. The riser string is then lowered with the tension lines already attached.

Completion riser technology has not kept pace with drilling riser technology. This is primarily due to the fact that drilling risers are predominantly owned by drilling contractors for specific rings. Improvements in handling and running drilling risers are customized to each ring. Completion risers on the other hand are predominantly owned by oil companies who may use the completion riser system on several different rigs. Because of this, completion riser systems are usually not designed for a specific rig.

Tension joints in completion riser systems have historically been a specialty joint containing four pad eyes. Run in the conventional manner, rig hands suspended on air tugger lines shackled the rig's tension lines onto the tension joint's pad eyes. Like the earlier drilling riser tensioning systems, this method of attaching the tension lines was a laborious task. If the rig was equipped with a drilling riser tension ring, the rig hands had to first disconnect the tension lines from the ring; thus, more labor was required to connect the tension lines to the completion riser. Recently a completion riser joint has been developed by a North Sea operator which was designed to mate directly with a particular rig's drilling riser tension ring. The tension joint included a standard completion riser joint with a circular ring of approximately 46.5 inches in diameter. When used in the field, the completion riser spider and the rotary table master bushings had to be removed in order to allow passage of the tension joint. Once passed, the master bushings and spider were repositioned back onto the rotary table. This proved to be a time consuming process. An object of the present invention is to provide an adapter apparatus for quickly and easily connecting a completion riser to a drilling riser tension ring which is supported under the platform, rotary table.

Another object is to provide an improved adapter apparatus which can connect to a completion riser and to a drilling riser tension ring to raise such tension ring by lifting on the completion riser tension ring and to tension the completion riser by exerting a tension on the drilling riser tension ring.

A further object is to provide an improved apparatus for connecting between a completion riser and a drilling riser tension ring which minimizes the difficult manipulations required of personnel suspended below the rotary table.

A still further object is to provide an improved apparatus for connecting between a completion riser and a drilling riser tension ring including a tension sleeve and an adapter tension ring with the tension sleeve having a size allowing it to be run through the rotary table without removing the spider and master bushings.

DESCRIPTION OF THE DRAWINGS

These and other objects and advantages are hereinafter described and explained with reference to the drawings wherein.

DESCRIPTION OF THE PREFERRED EMBODIMENT

Figures 1, 2, 3:
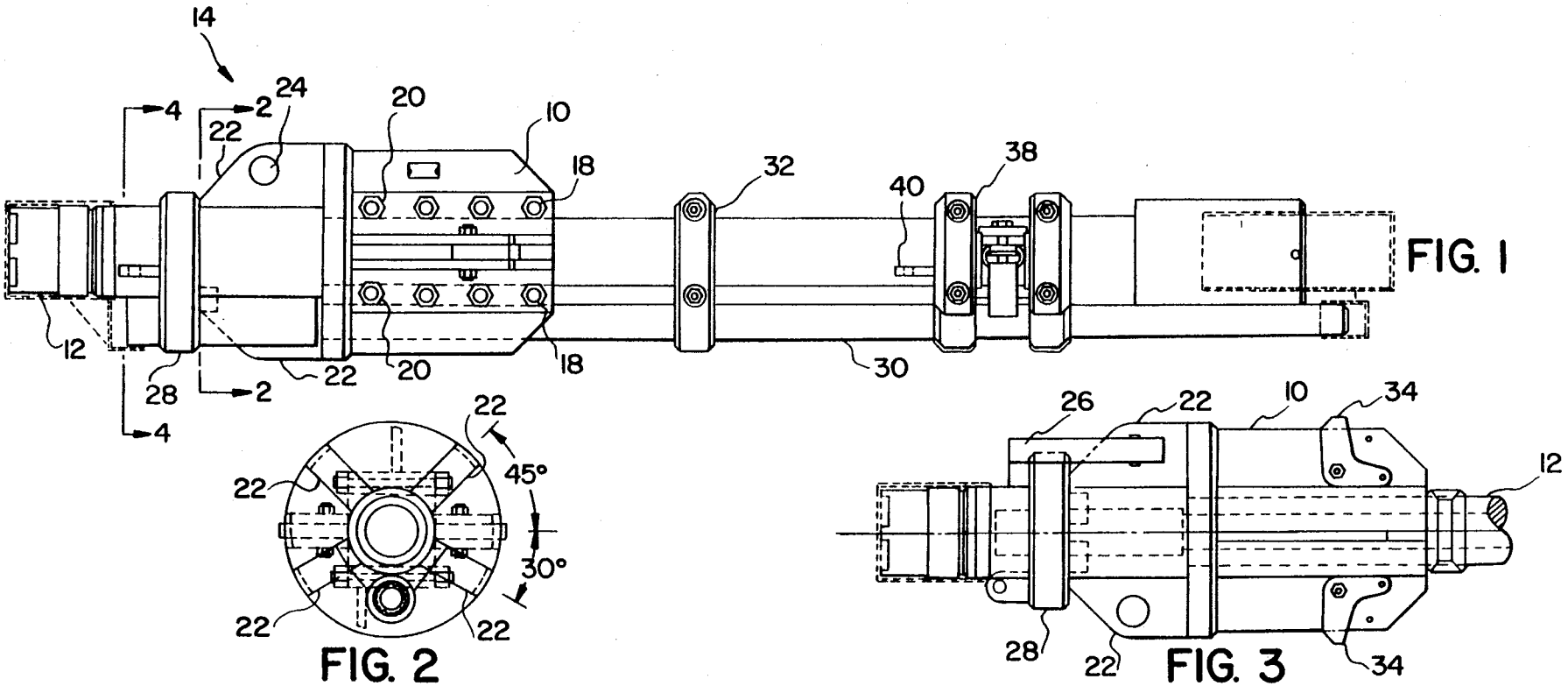
FIG. 1 is a side view of the improved tension sleeve of the present invention installed on a completion riser joint.
FIG. 2 is a transverse sectional view taken along line X—X in FIG. 1.
FIG. 3 is an elevation view of the tension sleeve taken in the direction indicated by the arrow labelled Z.
Figure 5:
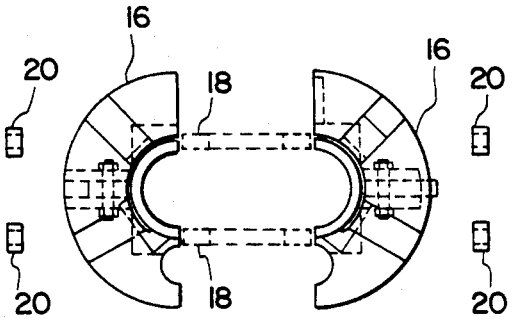
FIG. 5 is an exploded view of the two halves of the tension sleeve.
Figure 4:
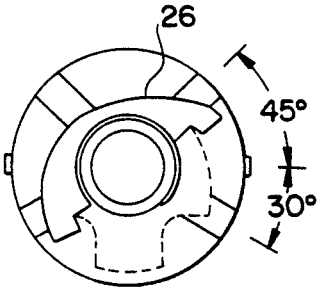
FIG. 4 is a transverse view of the head plate taken along line 4—4 in FIG. 1.
Figure 7:
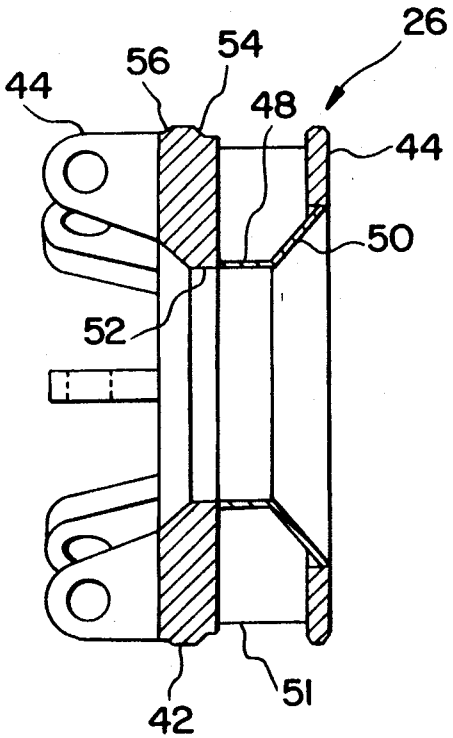
FIG. 7 is an axial sectional view of the improved adapter tension ring taken along line A—A in FIG. 6.
Figure 6:
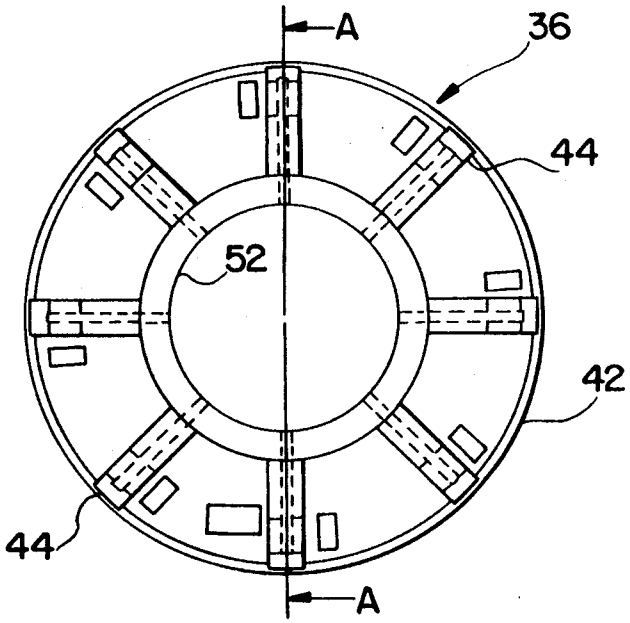
FIG. 6 is a plan view of the improved adapter tension ring.

As shown in FIG. 1, tension sleeve 10 is installed around the upper end of completion riser 12. Tension sleeve 10 may be installed on a section of completion riser 12 which is ten feet in length or longer. The combination of tension sleeve 10 installed on the upper section of riser 12 forms tension joint 14. Tension sleeve 10 includes two half shells 16, which are bolted together by suitable securing means, such as studs 18 and nuts 20. Ribs or pad eyes 22 are secured to the exterior of half shells 16 in the orientation shown in FIG. 2. Each of pad eyes 22 includes suitable opening 24 to which C clamp 26 (shown in FIG. 3) may be secured. Head plate 28 surrounds joint 14 immediately above sleeve half shells 16 and is secured thereto by C clamps 26. In this manner tension sleeve 10 is secured on riser joint 14 and moves therewith. Annulus line 30 which extends parallel to riser joint 14 is engaged by sleeve halves 16 and by clamp 32. Dogs 34 are pivotally mounted on the sides of the lower portion of tension sleeve 10 and provide the means for transmitting a lifting force exerted by the rig to the adapter tension ring 36 as hereinafter described. Clamp ring 38 provides suitable lifting pad eyes 40 as shown.

Adapter tension ring 36 includes annular plate 42 with a plurality of lifting lugs 44 secured to its upper surface, lower plate 46 which is joined to plate 42 by tubular section 48, flared section 50 and ribs 51. Opening 52 in annular plate 42 and tubular section 48 are sufficiently large to allow tension sleeve to pass therethrough. Annular plate 42 includes downwardly facing outer shoulder 54 and upwardly facing outer shoulder 56. Adapter tension ring 36 is designed to mate with and be secured to the drilling riser tension ring 58 as hereinafter described.

C clamp 26 holds tension sleeve 10 next to head plate 28 on tension joint 14. As tension joint 14 is being lowered through the rotary, C clamp 26 also transfers the weight of tension sleeve 10, adapter tension ring 36 and possibly the drilling riser tension ring 58 to head plate 28. Tension load applied to tension sleeve 10 by whichever means is transmitted to completion riser 12 through the underside of tension joint head plate 28.

To facilitate handling and installation of tension joint 14, a completion riser joint is premade up onto it. Tension joint 14 with the premade up pup joint is handled in the same manner as a standard completion riser joint. With handling tool installed, the tension joint is pulled up into the derrick, its pin protector remove, and its union nut is then made up onto the suspended string in the convention manner. String weight is then taken on the block and the spider rams are opened. The outer diameter of tension sleeve (e.g., 21.88") will pass through the spider bore without having to pivot open the spider body halves. Once tension sleeve has passed through the spider, the spider rams can be closed on the pup joint. With string weight supported by the spider, the rig crew can then attach the tension lines to tension sleeve lugs 22 while they are either standing on a cat walk or suspended on a riding belt. Alternative methods of installing tension lines may be used.

The surface joint is then made up onto the tension joint's pup joint and the string is lowered until the equipment has landed. The required tension is then applied to the riser string through the rig's tensioners. The riser string above the tension joint is tensioned by the rig's compensator. In mild conditions, the compensator can be disconnected to enable workover equipment to be attached to the surface tree.

In FIGS. 8 through 11, the operation of the improved tension sleeve 10, the adapter tension ring 36 and their functions with respect to tensioning of the completion riser 12 while utilizing the drilling riser tension ring 58 are described. Adapter tension ring 36 is installed within the rigs drilling riser tension ring 58. Suitable tension lines 60 are secured to drilling riser tension ring 58 and tension lines 62 are secured to adapter tension ring 36 for handling and tensioning by the rigs tension means (not shown).

Figure 8:
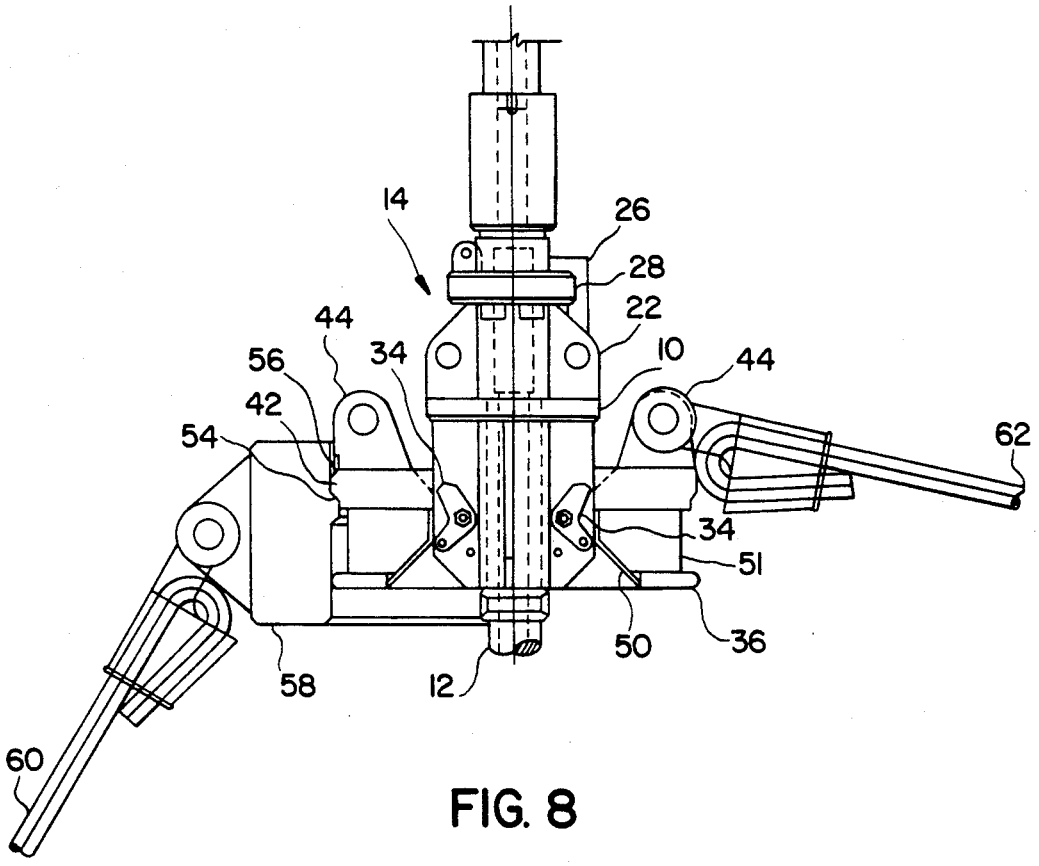
FIG. 8 is a schematic view showing the adapter completion riser tension ring secured to the drilling riser tension ring and the tension sleeve mounted on the completion riser being lowered through the bore of the adapter tension ring.

Once drilling is completed and the installation of the completion equipment starts, drilling riser tension ring 58 is stored and supported in a position under the rotary table. With tension ring 58 so supported, adapter tension ring 36 is secured therein by suitable means and then tension sleeve 10 which is mounted on completion riser 12 is lowered through opening 52 as shown in FIG. 8.

Figure 9:
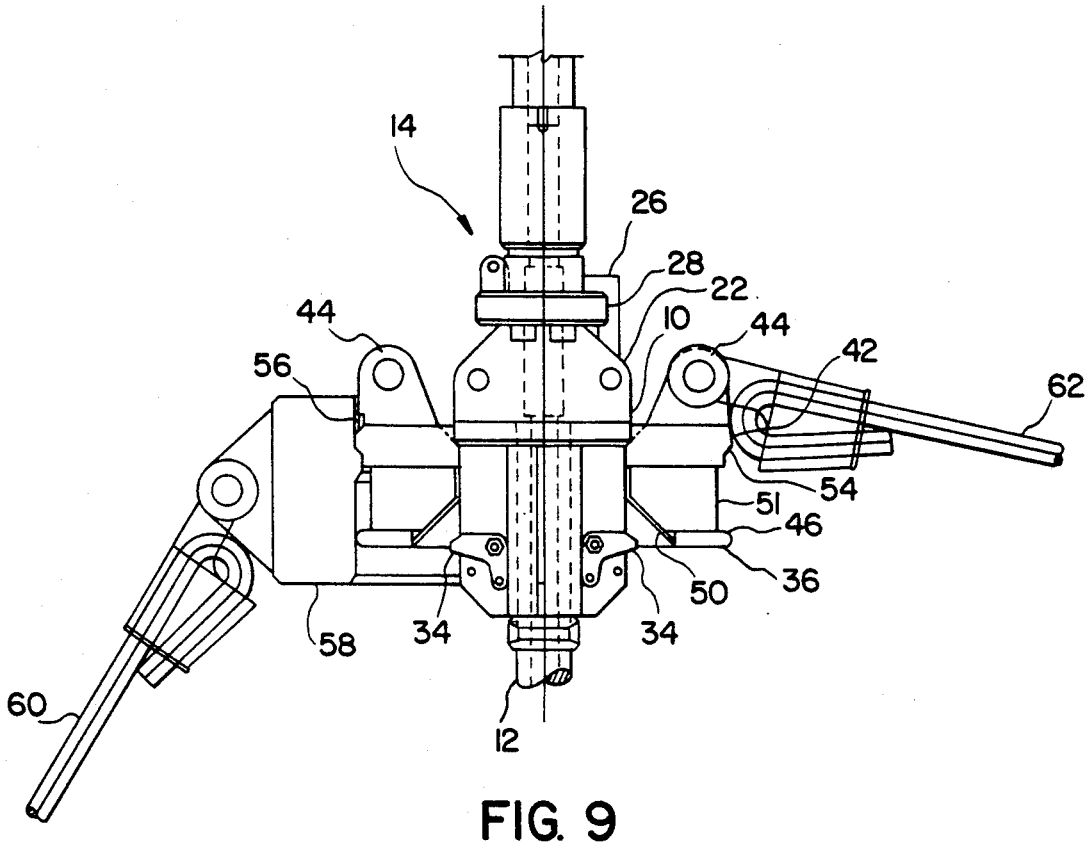
FIG. 9 is a similar schematic view to FIG. 8 but showing the tension sleeve extending through the adapter tension ring and with its engaging means positioned for engaging lower side of the adapter tension ring.
Figure 10:
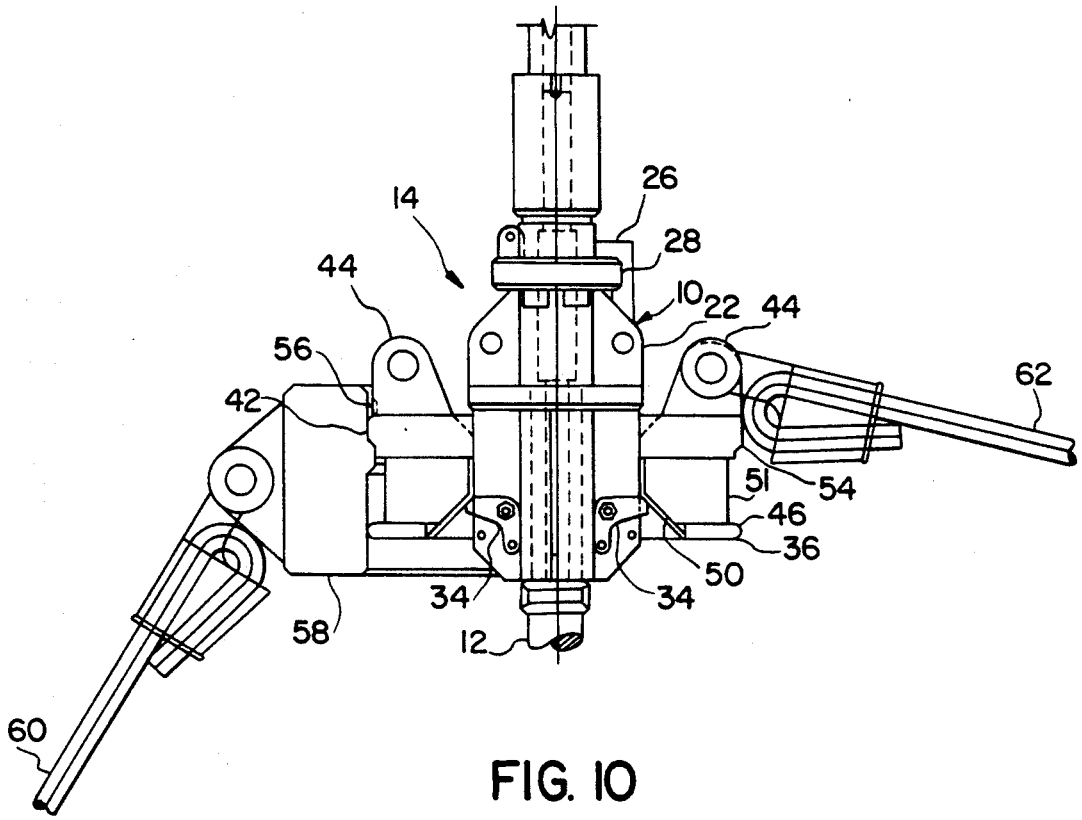
FIG. 10 is another schematic view showing the completion riser lifting the adapter tension ring and the tension ring.
Figure 11:
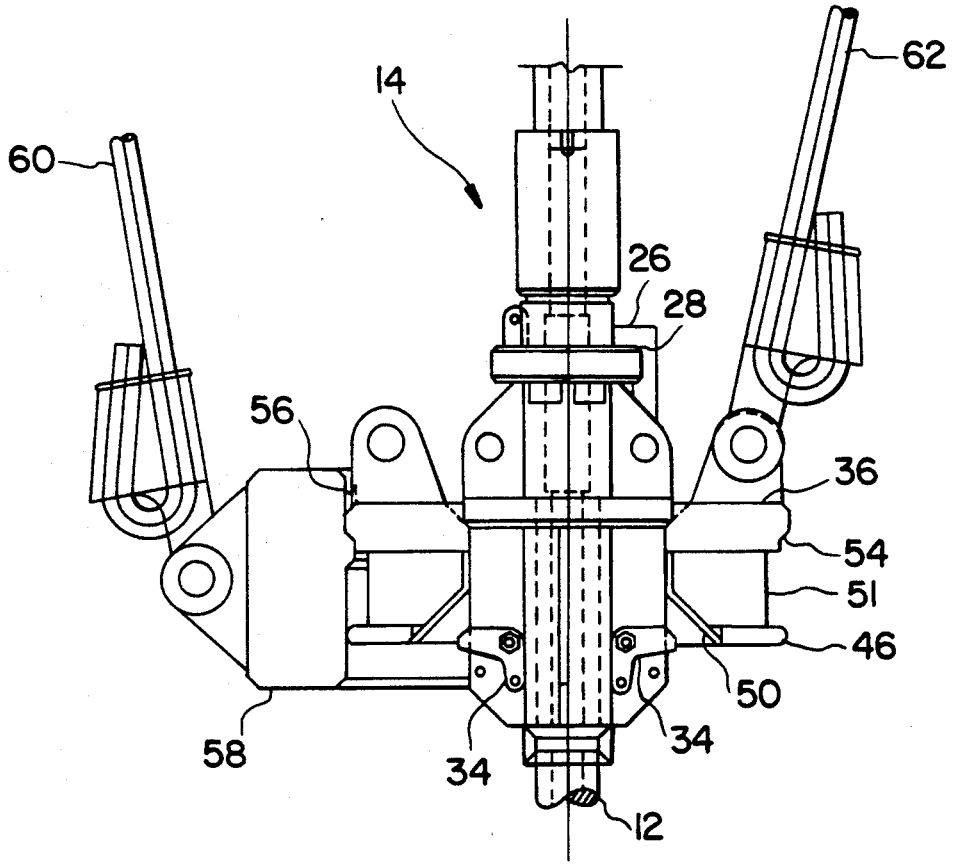
FIG. 11 is another similar schematic view showing the tensioning of the completion riser by tensioning through the rigs tensioners.

When dogs 34 have passed below lower tension ring 46, they are pivoted manually to the position shown in FIG. 9. In this position they will engage the underside of flared section 50 or adapter tension ring 36 when tension sleeve 10 and completion riser 12 are raised. In this position the completion riser adapter ring 36 and drilling riser tension ring 58 are raised by the completion riser 12 and tension sleeve 10. Thereafter, the rig tension lines 60 and 62 are used to control the tension in completion riser 12 as shown in FIG. 11.

A tension sleeve 10 having an outer diameter of 21.88 inches can be run through any spider having a minimum bore of 22.00 inches (standard size). The advantage being that the spider and master bushing do not have to be removed to run the tension joint through the rotary table. The pivoting dogs 34 on tension sleeve 10 enable the tension sleeve to be remotely locked into adapter tension ring 36. Adapter tension ring 36 can be designed to mate with a specific rig's drilling riser tension ring 58 or allow the rig's tension lines to be attached to some dedicated pad eyes. This is an advantage in that the tension lines are connected directly or indirectly to the completion riser tension ring 36 prior to running the completion riser 12.

What is claimed is:

1. Apparatus for tensioning a completion riser having an upper end comprising
   - a tension ring having means for exerting an upward load thereon and an internal landing seat,
   - a tension sleeve having a landing shoulder for engaging the internal landing seat in said tension ring,
   - means for clamping said tension sleeve to the upper end of the completion riser,
   - means for transmitting the upward load applied to the tension ring and said tension sleeve to the upper end of the completion riser,
   - said tension sleeve being sized to clamp around said upper end of said completion riser and to pass through a rotary table,
   - said tension ring being sized to engage within a drilling tension ring, and
   - means on said tension sleeve for transmitting a tension load exerted by the completion riser to said tension ring.

2. An apparatus according to claim 1 wherein said tension sleeve transmitting means includes
   - dogs pivotally connected to said tension sleeve and when pivoted in one direction allow passage of the lower end of the tension sleeve and the dogs through the tension ring and when pivoted in the direction opposite to said one direction being positioned to engage the underside of said tension ring to transmit a lifting force exerted by the completion string to the tension ring.

3. A subsea completion riser adapter for utilizing a drilling riser tension for the tensioning of the subsea completion riser comprising
   - an adapter tension ring having a central bore extending therethrough from one side to a second side of said adapter tension ring,
   - means for securing said adapter tension ring to said drilling tension ring,
   - an adapter tension sleeve, means for securing said adapter tension sleeve around a completion riser at a position near the upper end of the completion riser, means on said adapter tension sleeve for passing through the bore of said adapter tension ring from said one side to said second side and engaging the second side to support both said rings from said completion riser, means for tensioning said drilling riser, and means for transmitting the tensioning applied to said drilling riser through said adapter tension ring and said adapter tension sleeve to said completion riser.

* * * * *